US008746601B2

(12) United States Patent
Cox et al.

(10) Patent No.: US 8,746,601 B2
(45) Date of Patent: Jun. 10, 2014

(54) LIFTER BAR ASSEMBLY FOR A CRUSHING MILL AND METHOD OF INSTALLATION

(75) Inventors: Terry Cox, Artarmon (AU); Daniel Watt, Artarmon (AU); Graeme Hazell, Artarmon (AU)

(73) Assignee: Weir Minerals Australia, Ltd. (AU)

( * ) Notice: Subject to any disclaimer, the term of this patent is extended or adjusted under 35 U.S.C. 154(b) by 726 days.

(21) Appl. No.: 12/736,350

(22) PCT Filed: Mar. 30, 2009

(86) PCT No.: PCT/AU2009/000392

§ 371 (c)(1),
(2), (4) Date: Feb. 25, 2011

(87) PCT Pub. No.: WO2009/121129

PCT Pub. Date: Oct. 8, 2009

(65) Prior Publication Data

US 2011/0220752 A1 Sep. 15, 2011

(30) Foreign Application Priority Data

Apr. 1, 2008 (AU) ..... 2008901636

(51) Int. Cl.
*B02C 17/22* (2006.01)

(52) U.S. Cl.
USPC ..... 241/183; 241/DIG. 30; 29/401.1

(58) Field of Classification Search
USPC ..... 241/DIG. 30, 182, 183; 29/401.1
See application file for complete search history.

(56) References Cited

U.S. PATENT DOCUMENTS

| | | | | |
|---|---|---|---|---|
| 1,947,505 | A * | 2/1934 | Van Pelt | 241/183 |
| 4,394,982 | A | 7/1983 | Wilson | |
| 5,431,351 | A * | 7/1995 | Lejonklou | 241/183 |
| 6,206,310 | B1 * | 3/2001 | Schneider | 241/299 |

FOREIGN PATENT DOCUMENTS

| | | | |
|---|---|---|---|
| AU | 200210025 | B2 | 2/2002 |
| EP | 0233746 | A2 | 8/1987 |
| GB | 1080789 | A | 8/1967 |
| WO | WO 81/02396 | A1 | 9/1981 |
| WO | WO 02/11890 | A1 | 2/2002 |
| WO | WO 2007/048874 | A1 | 5/2007 |

* cited by examiner

*Primary Examiner* — Mark Rosenbaum
(74) *Attorney, Agent, or Firm* — Morriss O'Bryant Compagni

(57) ABSTRACT

A lifter bar assembly for a crushing mill is disclosed including: a plurality of lifter bar segments; the segments being arranged to be installed adjacent to one another to form a lifter bar; wherein each of the segments are of a weight which can be safely handled by a team of two people.

8 Claims, 2 Drawing Sheets

LIFTER BAR ASSEMBLY FOR A CRUSHING MILL AND METHOD OF INSTALLATION

TECHNICAL FIELD

The present invention relates to a lifter bar assembly for a crushing mill and a method of installing the lifter bar. The invention has particular application in mineral processing, power generation and general industrial crushing operations.

BACKGROUND ART

A typical grinding mill comprises a generally cylindrical drum with openings at one or both ends of the drum. Spaced about the inside wall of the drum are a number of lifter bars which are elongate objects which stand proud of the inner drum surface. The material to be ground is introduced to the drum along with grinding media in the form of a number of steel balls. The drum is caused to rotate and, as it does so, the lifter bars serve to lift the material and grinding media as the drum rotates, rather than merely sliding along the inside wall of the drum. At a certain point in the rotation of the drum, the material and grinding media falls away from the lifter bar by action of gravity to impact at the lower region of the drum. The force of the impact causes the material to be broken into smaller pieces thus effecting a grinding action.

The lifter bars become worn during operation and have a limited service life. It is necessary to replace the lifter bars from time to time. This is typically carried out by way of a specialised machine known as a liner handler. The liner handler moves on wheels and has a hydraulically operated arm which can grasp and carry a lifter bar. Having picked up a lifter bar, the handler is driven to the opening of the mill and the hydraulic arm extended to introduce the lifter bar into the mill and to hold the lifter bar in place whilst securing bolts are tightened. However, in the case of smaller mills, there is often insufficient clearance at the opening of the mill to allow use of a liner handler. This necessitates manual installation of lifter bars.

The lifter bars can typically weigh of the order of 200 kg and so a crew of at least four men is typically required to physically carry each lifter bar into some mills and to hold each bar in position whilst various securing bolts are aligned and tightened. This is a very strenuous task. Further, the floor of the mill is curved and generally uneven and may be littered with a mixture of crushed material and steel balls. This material may move when stepped on by persons entering the mill which presents a further hazard when installing large lifter bars inside the mill. There is a risk of injury to the installers of the lifter bars. It would be advantageous to reduce this risk.

SUMMARY OF THE DISCLOSURE

In a first aspect there is provided a lifter bar assembly for a crushing mill including: a plurality of lifter bar segments; the segments being arranged to be installed adjacent to one another to form a lifter bar; wherein each of the segments are of a weight which can be safely handled by a team of two people.

By providing lifter bar segments that can be safely carried by two people, risk of injury to installers of the lifter bars is reduced. Instead of requiring four or more persons, such segments can be carried, handled, positioned and secured more conveniently than conventional whole lifter bars. These segments do not require movement by a liner handler machine, which can be advantageous in situations where the crushing mill is of a small diameter with little clearance at the opening of the mill, which can create difficulties for the use of a liner handler.

In one embodiment, each of the segments may weigh less than 50 kg.

In one embodiment, each of the segments may weigh approximately 40 kg.

In one embodiment, each of the segments may be at least partially formed from rubber.

In one embodiment, the segments may include metal caps. In one form the metal cap(s) can be a block of metal which is joined to a rubber segment, where the metal cap is arranged at the in use high impact surface region of the lifter bar.

In one embodiment, each of the segments may be arranged in use to be fixed to the inside of the mill.

In one embodiment, each segment may include a channel and the assembly may include an elongate member, the elongate member may include fixing means for affixing it in relation to the inside of the mill, and the channel may be dimensioned to receive the elongate member.

In one embodiment, the fixing means may include a number of fasteners and further include a channel provided in the elongate member which is dimensioned to receive the heads of the fasteners.

In further embodiments, each of the segments may be arranged with alternative means for fixing to the inside of the mill. For example, each segment may be arranged to be directly fastened to the inside of the mill. In another form, some or each segment may be arranged to be directly fastened to an adjacent segment which is located at the inside of the mill.

In a second aspect there is provided a lifter bar assembly for a crushing mill including: a plurality of lifter bar segments; the segments being arranged to be installed adjacent to one another to form a lifter bar; wherein each segment includes a channel and the assembly includes an elongate member, the elongate member associated in use with fixing means for affixing it in relation to the inside of the mill, and the channels of the segments are each dimensioned to receive the elongate member. The use of the elongate member allows a number of segments to be securely installed adjacent to one another on the inside drum wall of the mill.

In a third aspect there is provided a liner assembly for a crushing mill including a lifter bar assembly according to either the first or second aspects.

In a fourth aspect there is provided a method of installing a lifter bar in a crushing mill including the steps of: providing at least one elongate member; providing a number of lifter bar segments, each segment including a channel which is dimensioned to receive the elongate member; and assembling the segments onto the elongate member inside the crushing mill.

By performing the assembly of the lifter bar inside of the crushing mill there is no necessity to move whole lifter bars by using a liner handler machine, which can be advantageous in situations where the crushing mill is of a small diameter with little clearance at the opening of the mill, which can create difficulties for the use of a liner handler.

In a fifth aspect there is provided a method of retro-fitting a lifter bar to a crushing mill including the steps of: providing a lifter bar assembly according to either of the first or second aspects and installing the assembly inside the crushing mill.

In a sixth aspect there is provided a method of retro-fitting a liner to a crushing mill including the steps of: providing a liner assembly according to the third aspect and installing the assembly inside the crushing mill.

In a seventh aspect there is provided a method of retro-fitting a lifter bar to a crushing mill including the steps of:

providing at least one elongate member; providing a number of lifter bar segments, each segment including a channel which is dimensioned to receive the elongate member; and assembling the segments onto the elongate member inside the crushing mill.

BRIEF DESCRIPTION OF THE DRAWINGS

An embodiment will now be described, by way of example only, with reference to the accompanying drawings, in which.

DETAILED DESCRIPTION OF AN EMBODIMENT

Figure 1:
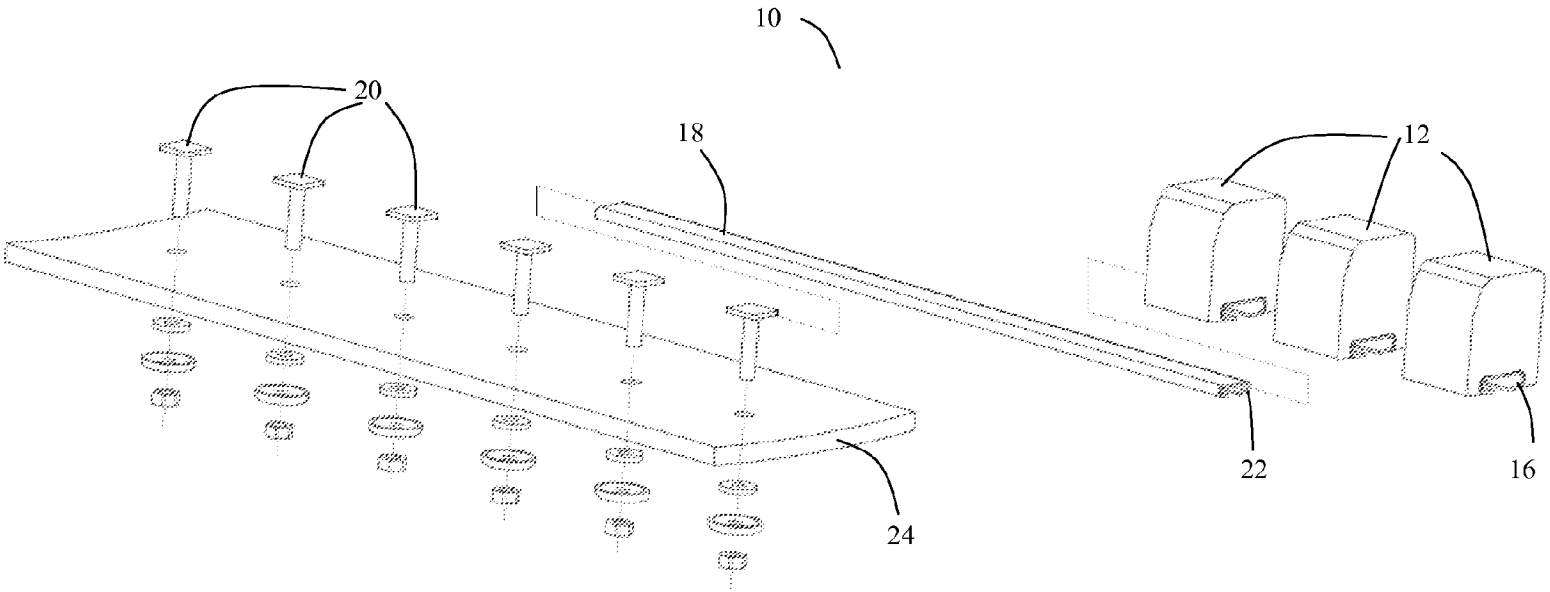
FIG. 1 is an exploded view of an embodiment of a lifter bar assembly according to the invention.
Figure 3:
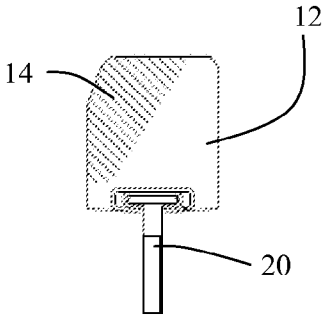
FIG. 3 is a side view of the lifter bar assembly of FIG. 1.
Figure 2:
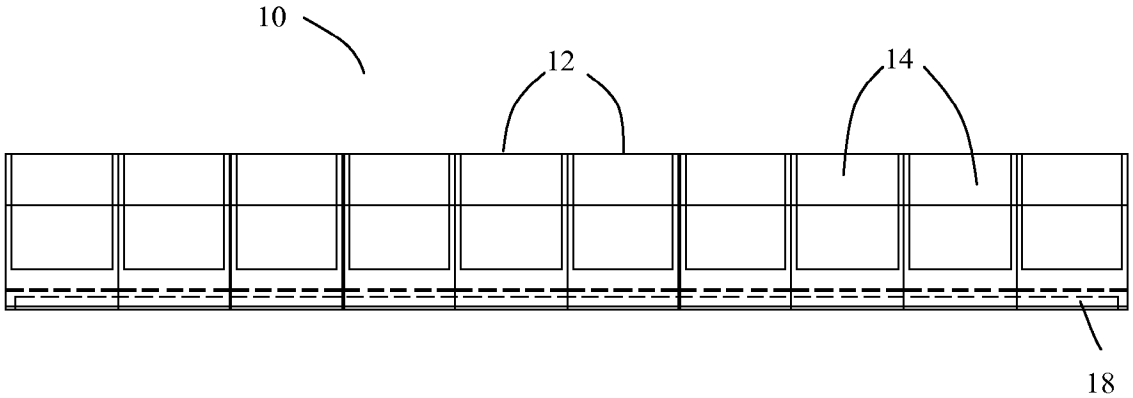
FIG. 2 is an elevation view of the assembly of FIG. 1 in an assembled state.

Referring to the figures, a lifter bar assembly 10 is shown including a number of block-like lifter bar segments 12, the segments being arranged to be installed adjacent to one another to form what is effectively a continuous, elongate lifter bar, as shown most clearly in FIG. 2. Each of the segments 12 is predominantly formed from rubber and includes a block-like metal cap portion 14 moulded and joined into the rubber (see FIG. 3) to provide additional wear resistance. The metal cap 14 is arranged at the in use uppermost front leading edge surface region of the lifter bar segment 12, where impact from grinding balls and mineral ore is greatest. Each of the segments 12 weighs approximately 40 kg.

The assembly 10 further includes an elongate member in the form of a T-shaped track 18. Each segment 12 includes a channel 16 which is dimensioned to be a sliding fit about T-track 18, to enable the segments 12 to be threaded onto T-track 18.

The T-track 18 is associated in use with a fixing means for fixing the T-track in relation to the inside of a crushing mill drum. The fixing means shown is in the form of a number of fasteners in the form of T-bolts 20 and a channel 22 provided in T-track 18. The channel 22 is dimensioned to be a sliding fit about the heads of the T-bolts 20. The T-bolts 20 pass through the wall 24 of the rotatable crushing mill drum (only a section of wall 24 shown) of a crushing mill.

The assembled lifter bar is best seen in FIG. 2 (T-bolts not shown). In this embodiment, the segments are each typically 178 mm wide with typically a 1 mm gap between segments. The T-track 18 is 1760 mm long and the length of the assembly is typically 1789 mm.

The lifter bar forms part of a liner assembly 10 for the interior of a crushing mill. The drum of the crushing mill is generally cylindrical and a series of lifter bars are positioned so as to be evenly spaced about the inside of the drum wall 24. Additional lifter bars can also be radially spaced about the end faces of the drum. The lifter bars are separated by shell plates (not shown) which protect the inside surface of the crushing mill drum from wear. Following a period of use, the lifter bars and shell plates become worn and require replacement.

The liner of the mill is installed in the following manner. Firstly, the T-bolts 20 are inserted through the drum wall 24 with heads of the T-bolts 20 being positioned in the channel 22 of the T-track 18. The T-bolts 20 are only loosely fastened at this stage. Then, the segments 12 are carried into the mill, each being handled by a team of two people. The segments 12 are then positioned by sliding onto the T-track 18 so that the T-track 18 is received in the respective channels 16 of the segments 12.

Once all of the segments 12 have been fitted to form the first lifter bar assembly 10, the shell plates are laid alongside the first lifter bar and extending beneath the lifter bar. The T-bolts 20 are then fully tightened to secure the lifter bar in place and also to retain the adjacent shell plate at the drum wall 24. Assembly of the next adjacent lifter bar can then be commenced and this process repeated around the interior of the mill. Gaps between lifter bars and shell plates are then filled with tarred oakum to properly seal the mill lining. Thus, the entire interior surface wall of the mill is finished with sacrificial wear material.

In some instances the assembly 10 described hereinabove is suitable for retrofitting into a mill which previously utilised a different form of lifter bar arrangement. In such a situation the previous lifter bar arrangement is detached from the crushing mill interior and discarded, and the new assembly 10 can be installed using the method described hereinabove.

It can be seen that these embodiments provide for a safer method of relining of grinding mills. Further, the relining method is faster which leads to reduced down time due to relining and hence provides a lower cost per tonne of processed material. The method allows for installation of metal capped lifter bars where previously due to weight constraints for carrying the lifter bars, it was previously not possible to install these.

An experimental trial of the above-described liner assembly 10 occurred at a gold mine in Australia. The mill in questions was a semi-autogenous grinding (SAG) mill with a diameter of 6100 mm and a length of 6555 mm. The mill used 125-150 mm steel balls in use. The mill interior was normally fitted with rubber lifter bars of a conventional design, and these were known to wear out over a 16 week operational cycle before replacement was needed. A 45-week wear trial involved the processing of 385,000 tonnes of ore through the mill.

In the experimental trial, the said mill was fitted with two lifter bar assembly 10 rows of segments 12 within the conventional mill lining arrangement that was already in use. Inspection of the mill interior at intervals during the service life showed that the wear profile of each assembly 10 was consistent, and that no movement of any of the segments 12 was detected. Whereas previously this mill had not been able to be fitted with continuous metal cap lifter bars because of the weight of these items and the inability of the workers to safely grapple with such objects in order to effect installation, the present trial showed that the new assembly of metal cap segments 12 was able to be retrofitted with simplicity and safety.

The trial allowed the inventors to project that the metal cap lifter bar assembly 10 will be able to provide up to 65 weeks of operational cycle use before replacement will be needed, which is a factor of 4 improvement over the equivalent existing rubber lifter bar wear results. This increase in mill lifter bar wear life will lead to a reduction in maintenance intervals and mill downtime requirements, which can provide operational cost advantages to the mine.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention that may be claimed may include the following novel arrangements, either singularly or in any combination thereof:

1. A lifter bar assembly for a crushing mill comprising:

an elongate member structured for being secured to the interior surface of a crushing mill by fixing means;

a plurality of lifter bar segments, each lifter bar segment of said plurality being structured with a channel sized for slidingly receiving said elongate member into said channel, the segments being arranged to be installed adjacent to one another along said elongate member to form a lifter bar;

fixing means for affixing said elongate member to the interior surface of a crushing mill, the fixing means including a number of bolt fasteners having heads, the fasteners being arranged in use to be passed through apertures in a wall of the crushing mill, the fixing means further comprising a channel which is provided in the elongate member and which is dimensioned to receive the heads of the bolt fasteners, and the heads of the bolts are slidable in the channel of the elongate member to allow the bolt fasteners to be aligned with apertures in the wall of the crushing mill, wherein each of the segments are of a weight which can be safely handled by a team of two people.

2. A lifter bar assembly according to claim 1, wherein each of the segments weighs less than 50 kg.

3. A lifter bar assembly according to claim 1, wherein each of the segments weighs approximately 40 kg.

4. A lifter bar assembly according to claim 1, wherein the segments are at least partially formed from rubber.

5. A lifter bar assembly according to claim 1, wherein the segments include metal caps.

6. A lifter bar assembly according to claim 1, wherein each segment is arranged in use to be fixed to the inside of the mill.

7. A method of retro-fitting a lifter bar to a crushing mill including the steps of:

providing a lifter bar assembly comprising:

an elongate member structured for being secured along the interior surface of a crushing mill by fixing means;

a plurality of lifter bar segments, each lifter bar segment of said plurality being structured with a channel sized for slidingly receiving said elongate member into said channel, the segments being arranged to be installed adjacent to one another along said elongate member to form a lifter bar; and fixing means structured for affixing said elongate member to the interior surface of a crushing mill, the fixing means comprising a number of bolt fasteners having heads, the fasteners being arranged in use to be passed through apertures in a wall of a crushing mill, the fixing means further including a channel which is provided in the elongate member and which is dimensioned to receive the heads of the bolt fasteners such that the heads of the bolts are slidably received along the channel of said elongate member to allow the bolt fasteners to be aligned with apertures in the wall of a crushing mill, wherein each of the segments are of a weight which can be safely handled by a team of two people; and installing the lifter bar assembly inside the crushing mill by sliding said fasteners along said elongate member to position and secure said elongate member to the crushing mill by securement of said fixing means to the crushing mill.

8. A method of retro-fitting a liner to a crushing mill including the steps of:

providing a liner assembly comprising:

an elongate member structured for being secured to a crushing mill by fixing means;

a plurality of lifter bar segments, each lifter bar segment of said plurality being structured with a channel sized for slidingly receiving said elongate member into said channel, the segments being arranged to be installed adjacent to one another along said elongate member to form a lifter bar;

fixing means for affixing said elongate member to the interior surface of a crushing mill, the fixing means comprising bolt fasteners having heads, the fasteners being arranged in use to be passed through apertures in a wall of a crushing mill, the fixing means further including a channel which is provided in the elongate member and which is dimensioned to receive the heads of the bolt fasteners and the heads of the bolts being slidably received in the channel of the elongate member to allow the bolt fasteners to be aligned with the apertures in the wall of the crushing mill, and wherein each of the segments are of a weight which can be safely handled by a team of two people; and installing the liner assembly inside the crushing mill by sliding said fasteners along said elongate member to position and secure said elongate member to the interior surface of the crushing mill.

* * * * *